United States Patent [19]

Moseley et al.

[11] 4,345,576

[45] Aug. 24, 1982

[54] MULTI-SPARK CD IGNITION

[75] Inventors: Gordon P. Moseley; Kurt W. Christner, both of Carson City, Nev.

[73] Assignee: Super Shops, Inc., Newport Beach, Calif.

[21] Appl. No.: 77,928

[22] Filed: Sep. 24, 1979

[51] Int. Cl.[3] ..... F02P 3/06

[52] U.S. Cl. ..... 123/604; 123/606; 123/637

[58] Field of Search ..... 123/604, 606, 636, 637, 123/638

[56] References Cited

U.S. PATENT DOCUMENTS

| | | | |
|---|---|---|---|
| 3,626,200 | 12/1971 | Sasayama | 123/604 X |
| 3,721,224 | 3/1973 | Del Zotto | 123/604 |
| 3,796,204 | 3/1974 | Hohne et al. | 123/604 |
| 3,858,563 | 1/1975 | Roth | 123/604 X |
| 3,934,570 | 1/1976 | Asik et al. | 123/598 |
| 3,943,905 | 3/1976 | Hartig | 123/604 |
| 4,077,380 | 3/1978 | Canup | 123/606 |
| 4,138,977 | 2/1979 | Grather et al. | 123/637 |
| 4,149,508 | 4/1979 | Kirk, Jr. et al. | 123/606 X |

*Primary Examiner*—Tony M. Argenbright
*Attorney, Agent, or Firm*—Browdy and Neimark

[57] ABSTRACT

An improved multi-spark capacitor discharge (CD) ignition having independent circuits for charging and discharging the main capacitor, a flyback DC to DC converter, and an inductive filter interposed between the ignition coil and the main capacitor on one side, and the charging transformer on the other side.

22 Claims, 4 Drawing Figures

MULTI-SPARK CD IGNITION

This invention relates to an ignition for internal combustion engines, and in particular to an improved multi-spark capacitor discharge ignition. More specifically, the invention pertains to such an ignition system useful for engines, and particularly for high performance engines such as in racing cars and boats.

By way of historical background, conventional Kettering ignition using points, condenser and a coil is characterized by the collapsing of the magnetic field surrounding the coil being the source of the energy of the plugs. This system has some inherent disadvantages. The time response characteristic of the coil is a limiting factor. However, it is an extremely simple and reliable system, in fact this system goes back to the earliest days of automobiles.

Capacitor discharge (CD) systems have been developed more recently. A capacitor is used to store the energy which is sent to the plug. The CD's have the advantage that higher energies can be stored, up to 600 volts as opposed to only 12 volts in conventional ignition. The speed problem is solved in that the capacitor can charge and discharge extremely rapidly. This extremely rapid discharge has a concurrent disadvantage in that there is an insubstantial duration in the spark in the combustion chamber.

A prolonged spark, or multi-sparks, produce cleaner and more efficient burning of the fuel, as is well known. The invention was in fact designed for performance and racing engines wherein speed is the most important characteristic. It is of course also applicable to "street" use, in that it saves gas, reduces pollution, and has other advantages set forth below.

Instead of one spark per plug as in conventional ignition systems, this invention provides up to nine sparks per plug, depending on engine speed. The invention provides proportionally fewer sparks per plug as engine speed increases up to 3000 RPM for an eight cylinder engine. Above 3000 RPM there is only one spark per plug, because there is simply not sufficient time to generate more than one spark at higher speeds.

This invention provides improvements and advantages over prior art multi-spark CD type ignitions. The improvements and advantages will be pointed out or will become evident in the following descriptions of the circuit in detail in the drawings, and in the claims.

The invention uses a flyback type converter for the DC to DC conversion. This has the advantage of using a much simpler transformer than prior systems to charge the main capacitor. The flyback converter also rapidly recharges the main capacitor after a spark occurs, so the ignition system is very fast, allowing engine speeds up to about 15,000 RPM on an eight cylinder engine, which is much higher than automotive engines now achieve. The flyback converter operates only after a spark occurs. It does not run continuously as in the converters in some prior art systems. This features minimizes the input current when the main capacitor is charged. Another feature of the flyback converter is the snubber used to protect the transistor which drives the converter transformer from transients which could damage the transistor.

Another feature is the inductive filter between the converter transformer and the main capacitor. This filter is used to protect the control circuitry from damage during the oscillations of the main capacitor and the ignition coil when a spark occurs.

Another feature is the way the multiple sparks are produced. A solid state component with a clock generator or clock portion and a binary counter is used to provide timing pulses that start the spark and recharge cycle during a timing or spark window that is a function of the engine speed. At very low engine speeds, such as are encountered during engine cranking and start up, the spark window time is overly large, so the number of timing pulses is limited to nine by an additional logic circuit. Thus, the number of sparks per plug is a function of engine speed, limited to a maximum of nine sparks at low speeds.

The above and other advantages of the invention will be pointed out or will become evident in the following detailed description and claims, and in the accompanying drawings also forming a part of the disclosure, in which:

Figure 1:
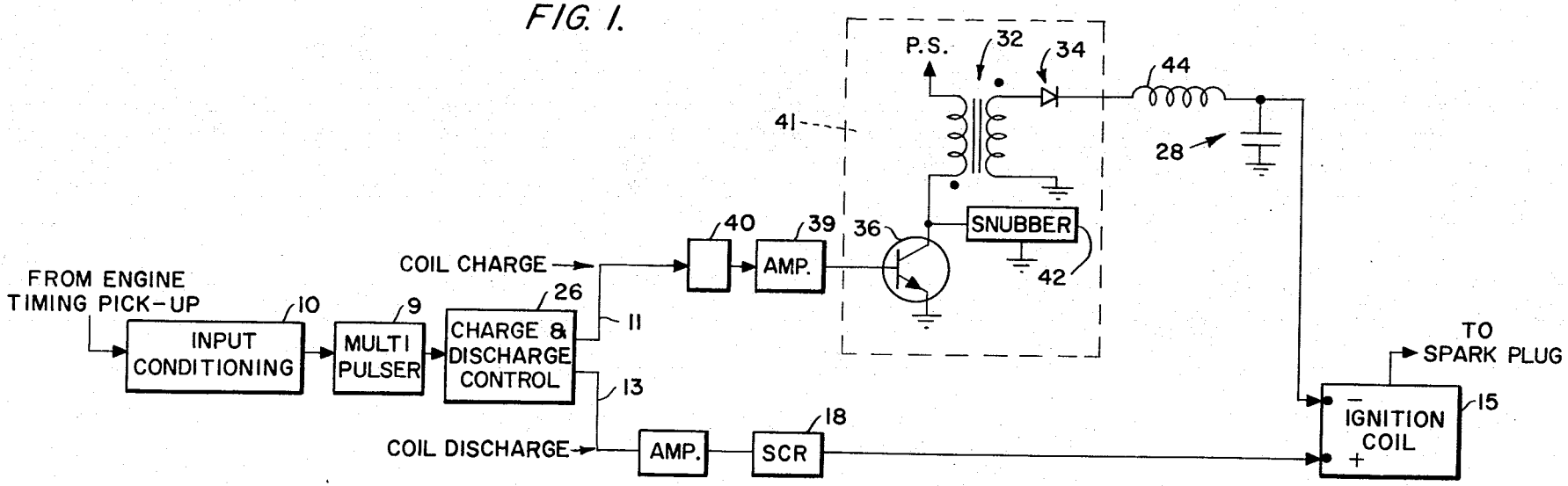
FIG. 1 is an overall block diagram of a circuit embodying the invention.

Referring in detail to the drawings, referring to the lefthand side of FIG. 1, the invention circuit operates under the control of the timing pulses from the engine. These pulses can be provided by conventional points, optical interrupters, magnetic pickups, or any such conventional timing means.

The timing pulses are fed into a block 10 which serves to "clean up" the timing pulse, so that it is sharp and without any static, fuzziness, or the like which could create false pulses and could have other detrimental effects on the remainder of the invention circuitry.

The cleaned up input pulse is passed on to a multipulser 9 which produces multiple pulses at a predetermined frequency, and provides same into the discharge and charge control block 26. The output of block 26 goes out on a pair of lines 11 and 13, the line 11 being the charge path for the main capacitor 28, and the line 13 being the independently operated discharge path which triggers the silicon controlled rectifier (SCR) 18, to independently discharge the main capacitor through the coil 15. The circuitry thus far, blocks 10, 9 and 26, are shown in greater detail in FIG. 2 and are explained in the corresponding description thereof below.

It will also be understood that the invention includes suitable conventional power supply means connected throughout the circuit as required, indicated in a few places by "P.S.", but otherwise not shown.

For the purpose of explanation of the rest of FIG. 1, it is sufficient to understand that the blocks 10, 9 and 26 produce on line 11 a series of pulses which correspond to the burst of multi-sparks which is to be produced within the engine by the coil 15. On line 13, these three blocks produce a signal or pulse which is to start each spark during the burst of multi-sparking under the control of the SCR. The two lines 11 and 13 are activated mutually exclusively of each other.

Referring to line 11, block 40 is built around a one shot multi-vibrator. Block 40 conditions the pulse before it goes on to the DC to DC converter and driver block 41. Finally, an amplifier 39 amplifies the conditioned pulse and passes it into the block 41. The one shot has an RC circuit associated with it which can be adjusted to provide the desired high voltage charge in the main capacitor.

As set forth above, the pulsing and multi-sparking will occur during a time window determined by the length of the timing pulse in the running mode of the engine, and by a maximum length as determined internally within block 9 in the case of idle and cranking conditions.

The overall operation of lines 11 and 13 as to independent charge and discharge is that the capacitor 28, the main capacitor, is isolated between each pulse in the burst of pulses from block 26 to correspond to the burst of sparks. The capacitor is recharged under control of a charge pulse along line 11, and discharged under control of a discharge pulse along line 13, and is repeatedly charged and discharged in this manner during the burst of pulses corresponding to the burst of sparks. During charging, SCR 18 is in an off condition so that the coil 15 is not grounded. After the capacitor 28 is charged, SCR 18 will turn on allowing energy in the capacitor to discharge. The SCR uses an inherency in the system, namely the ringing effect of the collapsing of the field around the coil 15 to automatically reset the SCR so that it is ready for the next pulse.

This repeated pulsing of the two lines 11 and 13 and charging and discharging of the capacitor 28 happens at solid state component speeds. In the successfully constructed embodiment, block 26 was set to operate at a frequency of 7500 times per second. This frequency occurs during the multi-sparking window determined by the width of the timing pulse out of the block 10, but within the window the events occur under the control of block 26.

Under the control of the pulses on line 11, the DC to DC flyback converter 41 transforms input power, typically 12 VDC, to a relatively large voltage on the order of 500 VDC to charge the main capacitor 28. Further, the flyback converter does so for the number of times necessary during the timing "window" determined by the width of the timing pulse, and does so only during that time and not on a constant or continual running basis as is a problem in much of the prior art. The constant running mode as is used in some of the prior art is a disadvantage in that it consumes energy at times when it is not necessary to do so. The invention solves that problem by providing multi-pulses and multi-sparks only during the timing window when sparking is to occur.

The block 41 accomplishes all of these desiderata using the flyback principle. The invention depends upon the transformer 32 to accomplish the above three goals. The turns ratio, 17 to 130 in the successfully constructed embodiment, because of well known transformer principles, will produce voltages of about 500 VDC at the secondary side. Transformer 34 will also, of course, accomplish the other two goals, namely reflecting each pulse and operating only so long as pulses are applied to its primary side. The two coils of transformer 32 are wound such that the primary is opposite the secondary, and is conventionally indicated by the dots on the drawing. The diode 34 permits only positive going current to pass through the conductor in which it is located. Thus, when the transistor 36 is conducting, under the control of block 39, there is negative voltage at the diode 34 which is not able to pass, thus isolating the main capacitor 28. When the transistor 36 switches off, the magnetic field surrounding the transformer 32 collapses which creates a positive voltage which causes a current through the diode 34 to charge the capacitor 28. Thus, it is the collapse of the magnetic field surrounding the transformer 32 that charges the main capacitor 28, and hence the name "flyback" for this circuit.

This arrangement has the advantage of being extremely quick and extremely simple. That is, the magnetic field collapses more quickly than it expands which enhances the overall speed of the system for charging the main capacitor.

Because of the highly inductive nature of the transformer 32 and its above-described manner of operation and use in the invention, there is a possibility of transients and spikes from the transformers damaging transistor 36. A snubber circuit 42 is provided to protect the transistor, and it does so by providing a path of much less resistance to such spikes and transients to thereby harmlessly shunt them away when they occur. The snubber 42 thus permits the use of much lighter duty and less expensive components, thus effecting substantial cost savings and economic advantages for the invention.

After the flyback converter 41 and between it and the main capacitor 28, the invention provides a small inductive coil 44. The collapsing of the field in the coil 15 will produce transients or ringing effects which could feed back into the converter and other circuitry to cause problems. Coil 44 serves as a filter to attenuate these oscillations and to prevent them from feeding backwards into other parts of the circuitry.

Figure 2:
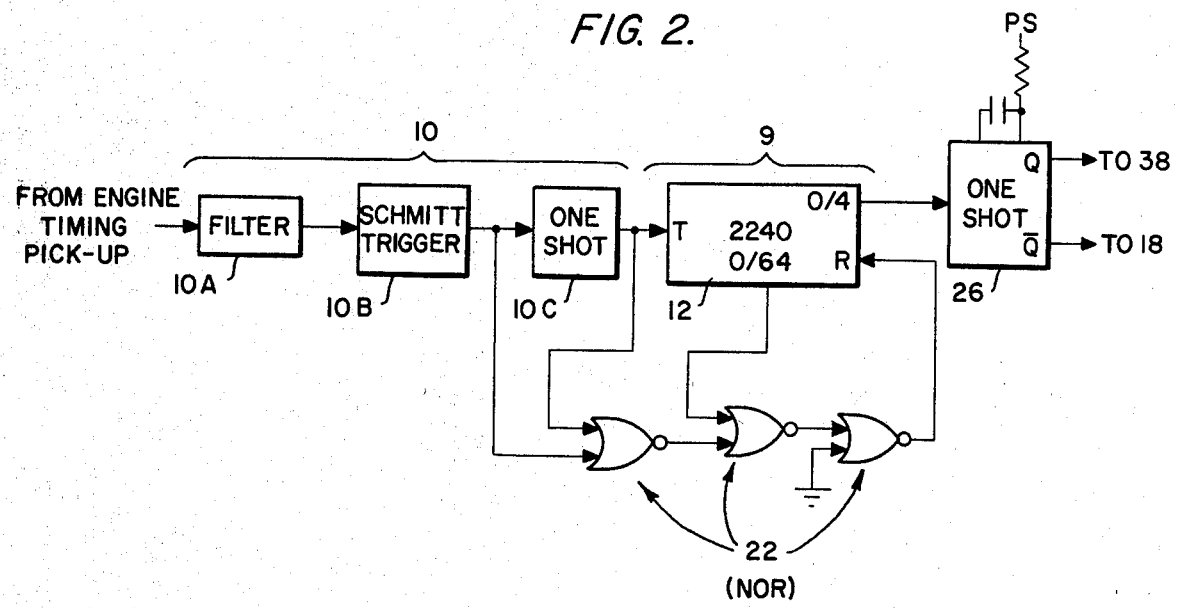
FIG. 2 is a more detailed schematic of a portion of the circuit of FIG. 1.

Referring now to FIG. 2, the block 10 of FIG. 1 is made up of three functions. Block 10A called "filter" simply cleans the noise off of the timing pulse as it comes in from the engine. The second block 10B cleans up the filtered timing pulse, providing sharp leading and trailing edges. The so cleaned timing pulse then passes on to the one shot 10C which triggers off of the leading edge of the pulse, providing a fixed length output pulse, regardless of the timing pulse width. Thus, the output of the block 10B is of the same duration as the timing pulse, and the output of 10C is of a predetermined duration set by an RC network not shown. Block 10B is preferably a Schmitt trigger circuit, and 10C is a one-shot.

Figure 4:
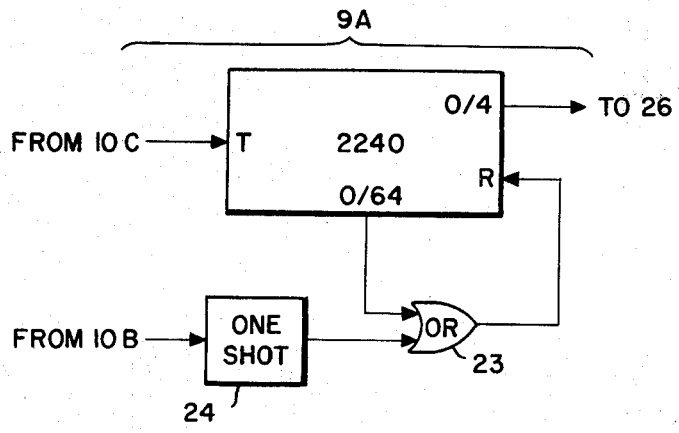
FIG. 4 is a second embodiment of the same portion of FIG. 2 shown in FIG. 3.

The multi-pulser 9 is shown in FIG. 2 in its preferred form and in FIG. 4 in an alternate form. It is built around a solid state component known as a 2240 integrated circuit (IC). This circuit has a built-in clock circuit and a binary counter. It also includes an RC circuit which sets the frequency at which the clock portion will produce its constant or fiducial pulses. The IC 2240 is turned on by the leading edge of the cleaned up timing pulse, and is turned off by its trailing edge, and thus it operates to produce output for the length of time i.e., within the "timing window", defined by the time duration of the timing pulse. However, the speed of the multi-pulses within that time window are controlled internally by the integrated circuit itself independently of the particular timing pulse.

The output of the block 12, is the output of the binary counter portion of that chip, and in particular the four count and the 64 count points or output pins are used. As with all binary counters, it will output signals at various pins corresponding to the binary counting system, namely at counts 2, 4, 8, 16, 32, 64 and so forth. The way the IC is wired into the circuit, all outputs at all pins are normally high or logic 1's. Upon receipt of a triggering pulse at T, namely the output of the one shot 10C, all pins go low or logic 0's. Each pin stays low for its number of counts, that is, the pin 4 will stay low for four counts and then go up and then remain high at logic 1 for four counts and then down for four more and so forth. The pin 64 which is used in the invention will stay down for 64 counts before going back up to a logic 1. Thus, each pin produces a square wave having a frequency corresponding to its binary number output position on the binary counter in the 2240.

Thus, an output, corresponding to one spark within a burst of multi-sparks, will be output at every fourth count, which corresponds to a frequency of 7500 divided by 4, which speed has been tested and found to be highly successful in operation in automobile engines.

The invention also comprises means to limit the number of sparks during cranking or idle conditions. At such time, the "time window" within which sparks could be supplied to a combustion chamber is very long, and an enormous number of sparks could be provided. Since the 2240 will run constantly during the time defined by the width of the timing pulse, an excessive number of sparks would be provided, which extra sparking is inefficient and can be destructive of the plugs and the engine because of the large amounts of energy to which it is unnecessarily subjected. Pin 64 of the 2240 is used for this purpose. It has been determined that 64 clock pulses corresponds to a length of time beyond which further sparking is ineffective. The cascade array of NOR gates 22 accomplishes this function. At the end of the time window, by sensing the trailing edge of the timing pulse, the 2240 is reset by a pulse to its terminal "R". Alternatively, as during cranking and idle, the earlier arriving condition of count 64 will also cause a logic high or one to be supplied to terminal R.

Figure 3:
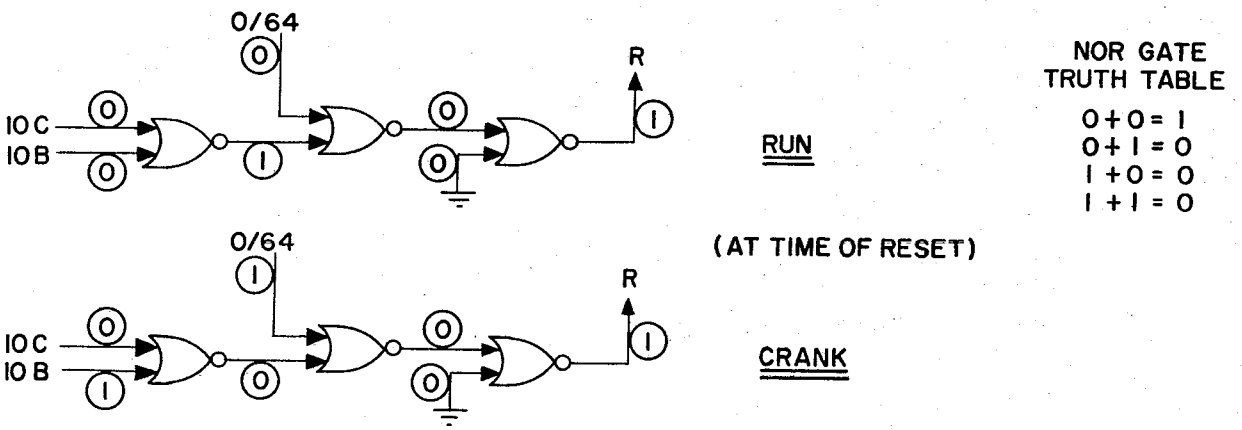
FIG. 3 is a hybrid diagrammatic showing a mathematical explanation of the operation of a part of the circuit of FIG. 2.

The manner in which this is done is illustrated by FIG. 3. the modus operandi or so called "truth table" for a NOR gate is that it will produce a logic 1 when both its inputs are logic 0, and in all other conditions, 0 plus 1, 1 plus 0 or 1 plus 1, it will always produce a logic 0. The upper half of FIG. 3 illustrates normal conditions, that is, when the time window going on and off should cause resetting of the 2240 which of course causes multi-sparking to stop. Both edges of the timing pulse will have passed through 10B and 10C has timed out, thus both inputs to the first NOR gate, on the left side, will both be logic 0. 0 plus 0 equals a 1 so the second NOR gate will receive a 1, the 64 still will not have counted out, and thus will still be 0, so the inputs to the second NOR gate will be 0 plus 1 producing an output of 0. This passes on to the third NOR gate the second output of which is always a logic 0 because it is grounded. The third NOR gate in the cascade, the last one controlling the reset terminal R, is simply an inverter. However, this is convenient in that NOR gates are typically supplied 4 to a single chip, and thus the capacity is available at no extra cost. 0 plus 0 equals 1 and thus the 2240 is reset during normal running under the control of the time window of the timing pulse.

In cranking or idle conditions, the length of the timing pulse is considerably longer than the time corresponding to 64 counts on 2240. In such case the 10B input, the trailing edge of the timing pulse, will still be high in that it will not yet be sensed, while the 10C has timed out and will therefore be a 0. 0 plus 1 produces a 0 output from the first NOR gate into the second, which combined with the logic high from the 64 pin, said pin having counted out and returned to its high state, combines in this second gate to produce a logic/0 output. This 0 continues with the ground 0 to the third NOR gate which again resets the 2240 this time at the end of the preset time determined to achieve efficient cranking. This time is made to correspond to nine sparks which has been determined experimentally to be the maximum number needed. That is, any sparks in excess of nine are inefficient and cause the disadvantages mentioned above.

These times and counts and the like have all been designed for eight cylinder engines. However, it is well within the expertise of those skilled in the art to make suitable accomodations, changes and adjustments as would be needed to adapt the invention for use in four or six cylinder engines. No conceptual modifications are required.

For eight cylinder engines, using this output pin count 4, the 2240 will produce 9 pulses at cranking speeds. At about 600 RPM of the engine, about 6 pulses will be produced at the spark plug, and the 2240 will continue to proportionally decrease the number of pulses from about 3 at 2000 RPM down to 1 at about 3000 RPM and all higher speeds.

FIG. 4 shows an alternate embodiment to the cascade array of the three NOR gates 22 wherein a single OR gate 23 is controlled by a one shot 24 which operates from the trailing edge output of block 10B. The pin 64 of the 2240 is the second input to OR gate 23, and thus just as in the FIG. 2 form, either the countdown to 64 within the 2240 or the trailing edge of the timing pulse, whichever occurs first, will operate the reset R of the 2240. The three NOR gates are preferred because the one shot 24 is not required, thus reducing the components needed.

The outputs at pin 4, which correspond to the sparks within the burst of sparks, pass on to the one shot 26. The two complementary, mutually exclusive and opposite outputs thereof, conventionally called Q and Q, are used to control the charge and discharge operation independently. It has a conventional RC circuit as shown, to control its pulse width.

The charging of the main capacitor must occur within the time between the spark discharges. The charging function takes about 800 micro seconds. Thus, the charging and discharging of the capacitor is completely independent of the engine operation up to the maximum speed which can be controlled. This is to be contrasted with some prior art devices where charging and discharging of the capacitor happens at the same time. This tends to abuse the DC to DC converter and has other disadvantages well known to those skilled in the art.

The invention also contemplates certain subcombinations. That is, if the block 9 were omitted, an improved single spark CD ignition would be provided. Alteratively, the FIG. 2 operation could go onto other kinds of ignition circuits, other than that shown to the right of block 26 in FIG. 1.

While the invention has been described in detail above, it is to be understood that this detailed description is by way of example only, and the protection granted is to be limited only within the spirit of the invention and the scope of the following claims.

I claim:

1. A multi-spark ignition for an internal combustion engine; said engine comprising a combustion chamber having a spark plug therein, an ignition coil for producing electrical energy to cause said spark plug to spark, means to supply said energy to said plug, means for producing timing pulses from said engine, each said timing pulse having a time duration proportional to the speed of said engine; said ignition comprising means to produce multiple pulses corresponding to multi-sparks at said plug, and means to cause said pulse producing means to output said pulses for a period of time which is the shorter of said time duration of each said timing pulse or a predetermined period of time about equal to the maximum time required for complete combustion in said chamber during slow engine speed operation as in cranking or idle.

2. The combination of claim 1, said multiple pulse producing means comprising an integrated circuit comprising a clock portion and a binary counter portion, means to adjust the frequency of said clock pulses, means to output the pulses at a selected pin of said counter portion into a DC to DC converter; said pulse producing causing means comprising means to cause said clock portion to commence clock pulse production in response to receipt of a leading edge of each said timing pulse and means to cause said clock portion to stop clock pulse production upon receipt of either a trailing edge of each said timing pulse or a pulse from a second selected output of said timing pulse or a pulse from a second selected output of said counter portion whichever occurs first in time; and the clock pulse count at which said second output activates corresponding to said maximum time for complete combustion.

3. The combination of claim 2, said clock pulse stopping means comprising an array of three NOR gates arranged in cascade.

4. The combination of claim 2, said clock pulse stopping means comprising an OR gate.

5. The combination of claim 1, said ignition being of the CD type, and DC to DC converter means to transform input power into high voltage energy under the control of said pulses, and said DC to DC converter comprising a flyback converter comprising a two winding transformer driven by a transistor.

6. The combination of claim 5, said transformer comprising primary and secondary coils wound oppositely to each other and having a turns ratio such that the secondary thereof charges said capacitor to about 500 volts DC.

7. The combination of claim 5, and a protective snubber circuit connected to said transistor and said transformer.

8. The combination of claim 1, said ignition being of the CD type and comprising a main capacitor for supplying energy to said coil, means to store said high voltage energy in said main capacitor, means to discharge said energy stored in said capacitor through said coil, and means to cause said storing means and said discharge means to operate independently of each other.

9. The combination of claim 5, and inductive filter means interposed between the seconary transformer coil in said flyback DC to DC converter and the main capacitor of said ignition.

10. A multi-spark CD ignition for internal combustion engines comprising multiple pulse producing means, a main capacitor, a flyback DC to DC converter between said pulse producing means and said capacitor to charge said capacitor to produce multi-sparks corresponding to said multi-pulses, said converter comprising a transformer, an inductive filter between said transformer and said main capacitor, said engine comprising a combustion chamber having a spark plug therein, an ignition coil for producing electrical energy to cause said spark plug to spark, means to supply said energy to said plug, means for producing timing pulses from said engine, each said timing pulse having a leading edge and a trailing edge which together define a time duration proportional to the speed of said engine; means to cause said pulse producing means to output said pulses for no longer than said time duration of each said timing pulse, said DC to DC converter transformer comprising a two winding transformer driven by a transistor, said multiple pulse producing means comprising an integrated circuit comprising a clock portion and a binary counter portion, means to adjust the frequency of said clock pulses, means to output the pulses at a selected pin of said counter portion into said DC to DC converter, means to cause said clock portion to commence clock pulse production in response to receipt of the leading edge of each said timing pulse, means to cause said clock portion to stop clock pulse production upon receipt of either the trailing edge of each said timing pulse or a pulse from a second selected output of said counter portion whichever occurs first in time, and the clock pulse count at which said second output activates corresponding to a period of time about equal to the maximum time required for complete combustion in said chamber during a slow enginer speed operation as in cranking or idle.

11. The combination of claim 10, said transformer comprising primary and secondary coils wound oppositely to each other and having a turns ratio such that the secondary thereof charges said capacitor to about 500 volts DC.

12. The combination of claim 10, and a snubber circuit connected to said transistor and said transformer.

13. The combination of claim 10, means to store said high voltage energy in said main capacitor, means to discharge said energy stored in said capacitor through said coil, and means to cause said storing means and said discharge means to operate independently of each other.

14. The combination of claim 10, said clock pulse stopping means comprising an array of three NOR gates arranged in cascade.

15. The combination of claim 10, said clock pulse stopping means comprising an OR gate.

16. A capacitor discharge multi-spark ignition for an internal combustion engine; said engine comprising a combustion chamber having a spark plug therein, an ignition coil for producing electrical energy to cause said spark plug to spark, means to supply said energy to said plug, means for producing timing pulses from said engine, each said timing pulse having a time duration proportional to the speed of said engine; said ignition comprising means to produce multiple pulses corresponding to multi-sparks at said plug, means to cause said pulse producing means to output said pulses for no longer than said time duration of each said timing pulse, DC to DC converter means interposed between said multiple pulse producing means and said ignition coil to transform input power into high voltage energy under the control of said pulses, said DC to DC converter comprising a flyback converter comprising a two winding transformer driven by a transistor, said multiple pulse producing means comprising an integrated circuit comprising a clock portion and a binary counter portion, means to adjust the frequency of said clock pulses, means to output the pulses at a selected pin of said counter portion into said DC to DC converter, means to cause said clock portion to commence clock pulse production in response to receipt of a leading edge of each said timing pulse, means to cause said clock portion to stop clock pulse production upon receipt of either a trailing edge of each said timing pulse of a pulse from a second selected output of said counter portion whichever occurs first in time, and the clock pulse count at which said second output activates corresponding to a period of time about equal to the maximum time required for complete combustion in said chamber during slow engine speed operation as in cranking or idle.

17. The combination of claim 16, said transformer comprising primary and secondary coils wound oppositely to each other and having a turns ratio such that the secondary thereof charges said capacitor to about 500 volts DC.

18. The combination of claim 16, and a snubber circuit connected to said transistor and said transformer.

19. The combination of claim 16, said ignition comprising a main capacitor for operating said coil, means to store said high voltage energy in said main capacitor, means to discharge said energy stored in said capacitor through said coil, and means to cause said storing means and said discharge means to operate independently of each other.

20. The combination of claim 16, said clock pulse stopping means comprising an array of three NOR gates arranged in cascade.

21. The combination of claim 16, said clock pulse stopping means comprising an OR gate.

22. The combination of claim 16, and inductive filter means interposed between the secondary transformer coil in said flyback DC to DC converter and the main output capacitor of said ignition.

* * * * *